US007423208B2

(12) United States Patent
Muncy et al.

(10) Patent No.: US 7,423,208 B2
(45) Date of Patent: Sep. 9, 2008

(54) STRINGED INSTRUMENT AND ASSOCIATED FRET MAPPING METHOD

(76) Inventors: Gary O. Muncy, 130 Shadden Rd., Tellico Plains, TN (US) 37385; James Norman Griffitts, 4937 Indian Warpath Rd., Maryville, TN (US) 37803

( * ) Notice: Subject to any disclaimer, the term of this patent is extended or adjusted under 35 U.S.C. 154(b) by 0 days.

(21) Appl. No.: 11/837,931

(22) Filed: Aug. 13, 2007

(65) Prior Publication Data

US 2008/0022836 A1 Jan. 31, 2008

Related U.S. Application Data

(62) Division of application No. 11/035,618, filed on Jan. 14, 2005, now Pat. No. 7,256,336.

(51) Int. Cl.
*G10D 3/06* (2006.01)

(52) U.S. Cl. ..... 84/314 R

(58) Field of Classification Search ..... 84/314 R
See application file for complete search history.

(56) References Cited

U.S. PATENT DOCUMENTS 652,353 A * 6/1900 Edgren ..... 84/267
2,489,657 A * 11/1949 McBride ..... 84/317
2,500,172 A * 3/1950 Gillenwater ..... 84/723
2,604,806 A * 7/1952 Billeci ..... 84/455
2,816,469 A 12/1957 Hutchison
3,103,846 A 9/1963 Webster
3,469,489 A * 9/1969 Barth ..... 84/314 R
3,787,600 A 1/1974 Muncy
3,894,468 A * 7/1975 Dunlap ..... 84/314 R
3,911,778 A 10/1975 Martin
3,915,049 A 10/1975 Bean
4,064,780 A 12/1977 Bond
4,308,784 A 1/1982 Eizonas
4,359,923 A 11/1982 Brunet
4,611,523 A 9/1986 McFarland
4,620,470 A 11/1986 Vogt
4,635,518 A 1/1987 Meno
4,723,469 A 2/1988 Vogt
4,777,858 A * 10/1988 Petschulat et al. ..... 84/314 R
4,981,064 A * 1/1991 Vogt ..... 84/314 R
4,982,640 A 1/1991 Buscarino
4,987,816 A 1/1991 Poor
5,033,351 A 7/1991 Nomura
5,085,115 A 2/1992 Schlink
5,133,239 A 7/1992 Thomas
5,325,757 A * 7/1994 Ghenea ..... 84/314 R
5,481,956 A 1/1996 LoJanco et al.

(Continued)

*Primary Examiner*—Lincoln Donovan
*Assistant Examiner*—Robert W Horn
(74) *Attorney, Agent, or Firm*—Pitts & Brittian, P.C.

(57) ABSTRACT

A stringed instrument and associated fret mapping method. The instrument includes a neck having a fret board provided with a plurality of frets having offset string contact regions along their length, whereby accurate intonation of a note is achieved when a string is brought into contact with one of the string contact regions and a note is played. The fret mapping method utilizes a test instrument having a fret board that is longitudinally movable toward and away from the nut of the test instrument. The method utilizes this movable fret board to determine the desired locations of string contact regions for frets on the fret board of a stringed instrument of the present invention.

6 Claims, 10 Drawing Sheets

U.S. PATENT DOCUMENTS 5,589,653 A 12/1996 Rose
5,631,432 A * 5/1997 Muncy ..... 84/293
5,696,337 A 12/1997 Hall
5,750,910 A 5/1998 LoJanco
5,756,914 A 5/1998 Streibl
5,760,322 A * 6/1998 Ward et al. ..... 84/314 R
5,804,753 A 9/1998 Speer
5,814,745 A 9/1998 Feiten et al.
D401,266 S 11/1998 LoJanco
5,955,689 A 9/1999 Feiten et al.
5,998,714 A 12/1999 McNamara
6,069,306 A 5/2000 Isvan et al.
6,114,618 A 9/2000 Anke
6,120,910 A 9/2000 Szenics
6,350,940 B1 * 2/2002 Upchurch et al. ..... 84/314 R
6,369,306 B2 4/2002 Chapman
6,426,454 B1 7/2002 Gregory
6,433,264 B1 8/2002 Gimpel et al.
6,512,168 B2 1/2003 Cortes
6,583,346 B2 6/2003 LoJanco
6,613,969 B1 9/2003 Petillo
6,706,957 B1 3/2004 Merkel
6,825,406 B2 11/2004 Thidell
6,870,084 B2 3/2005 Feiten et al.
6,881,882 B2 4/2005 Ito et al.
6,956,158 B2 * 10/2005 Booker ..... 84/312 R
7,012,180 B2 * 3/2006 Koeppe et al. ..... 84/314 R
7,084,337 B1 8/2006 Schroeder
7,256,336 B2 8/2007 Muncy et al.
2003/0029298 A1 2/2003 Feiten et al.
2004/0173080 A1 * 9/2004 Pye et al. ..... 84/314 R
2004/0177742 A1 * 9/2004 Orme ..... 84/314 R
2005/0155479 A1 7/2005 Feiten et al.

* cited by examiner

| EXPRESSION AS THOUSANTS OF AN INCH MOVEMENT | EXPRESSION AS CENTS |
|---|---|
| .052 .026 .026 .052 .032 .022 | 4 2 2 4 2 1.5 |
| .052 .040 .045 .074 .040 .030 | 6 2 3 5 2 2 |
| .045 .035 .035 .052 .034 .026 | 6 3 3 5 2 2 |
| .045 .045 .045 .060 .026 .015 | 6 3 3 5 3 1 |
| .064 .061 .050 .058 .040 .026 | 7 4 3 5 3 2 |
| .060 .050 .050 .050 .022 .015 | 7 4 3 6 3 1 |
| .060 .055 .040 .058 .030 .020 | 8 4 3 5 3 .5 |
| .056 .032 .028 .050 .030 .015 | 10 4 3 5 3 1 |
| .070 .048 .034 .070 .034 .015 | 11 5 4 7 5 1.5 |
| .084 .050 .020 .040 .022 .008 | 12 6 3 6 3 1 |
| .085 .062 .010 .040 .020 .005 | 12 6 1 6 3 1 |
| .100 .050 .014 .045 .020 .000 | 14 7 1 7 3 0 |
| .094 .080 .002 .050 .025 .010 | 16 7 0 7 4 1 |
| .106 .067 .026 .076 .056 .035 | 18 12 4 12 8 5 |
| .110 .073 -.018 .039 .050 .014 | 21 14 - 1 6 7 - 2 |
| .122 .090 .005 .070 .058 .033 | 22 13 3 13 7 5 |
| .084 .033 -.018 .030 .030 -.005 | 16 7 -2 7 7 - .5 |
| .090 .047 -.020 .042 -.035 .005 | 18 9 - 2 8 - 4 .5 |
| .100 .057 -.023 -.023 .025 -.003 | 19 8 - 2 - 3 4 - 1 |
| .100 .049 -.023 .025 .016 -.011 | 21 12 - 2 3 2 - 2 |
| .135 .080 .010 .011 .050 .026 | 26 19 3 3.5 14 7 |
| .092 .051 - 001 - .043 .059 .061 | 23 20 - .5 16 12 8 |
| .090 .046 - .004 -.036 .070 .062 | 24 18 -1 - 9 18 12 |
| .078 .053 -.002 -.051 .063 .058 | 22 19.5 - 1.5 -12 17 14 |

STRINGED INSTRUMENT AND ASSOCIATED FRET MAPPING METHOD

CROSS-REFERENCE TO RELATED APPLICATIONS

This Application is a divisional application of U.S. patent application Ser. No. 11/035,618, filed on Jan. 14, 2005.

STATEMENT REGARDING FEDERALLY SPONSORED RESEARCH OR DEVELOPMENT

Not Applicable

BACKGROUND OF THE INVENTION

1. Field of Invention

This invention relates to stringed instruments. More specifically, the present invention is related to a fretted stringed instrument and a method for mapping the desired location of string contact regions along the length of a fret of a stringed instrument.

2. Description of the Related Art

Fretted stringed musical instruments typically employ equal temperament tuning, equal temperament tuning being a system of musical tuning wherein the octave is divided into a series of equal steps. For example, conventional guitars utilize a twelve-tone equal temperament system wherein the twelfth fret defines the octave. The frets are typically perpendicularly disposed along the length of the fret board, and parallel to one another. The spacing of frets along the fret board is commonly calculated in accordance with a mathematical formula referred to as the "Rule of Eighteen". Pursuant to the "Rule of Eighteen" as originally derived the vibrating length of the string (the length of the string between the points at which the string contacts the bridge and nut of the instrument) was divided by 18, with the quotient being the distance between the point at which the string initially contacts the nut and the apex or leading edge of the first fret, thereby determining the position of the first fret relative to the nut. The vibrating length of the string between the first fret and the bridge was then divided by 18 to determine the position of the second fret, with the positions of the remaining frets being determined in like manner. Subsequently, the "Rule of Eighteen" was refined to utilize 17.817 as the denominator rather than 18 (hereinafter referred to as the "modified Rule of Eighteen"). Whereas the modified "Rule of Eighteen" has been helpful in determining fret placement, and is utilized with respect to most conventional fretted instruments utilizing equal temperament tuning, it has long been recognized that the "Rule of Eighteen" is imprecise and does not provide perfect intonation of each string at each fret location. In this regard, the "Rule of Eighteen" does not take into consideration that strings are not under constant tension when a fretted stringed instrument is being played. By depressing a string, the tension on that string is increased which translates into a change in pitch, or sharpening, of the note being produced. Moreover, the amount of the increase in tension on the string increases as the fretted position gets closer to one of the structures supporting the string, i.e. the nut or the bridge. Accordingly, the pitch deviation are greater as notes are played farther from the octave, the octave being the twelfth fret where a twelve-tone equal temperament system is utilized.

Efforts have been made over the years to lessen the intonation deviations inherent in the use of the "Rule of Eighteen" system. For example, guitars and other fretted instruments have been provided with adjustable bridges, and/or adjustable nuts, which at least allow the vibrating length of individual strings to be positioned over the frets to minimize pitch deviations. E.g. U.S. Pat. No. 5,481,956. However, whereas adjustable bridges, and/or adjustable nuts, can be used to insure proper intonation at the octave or some other selected fret location, intonation deviations at other fret locations will remain due to the changing tension on the strings at other fret locations. It has long been recognized that these deviations can be compensated for by repositioning the fret along their length at individual string location. For example, early fretted instruments utilized gut string frets that were tied around the neck of the instrument and could be moved to fine tune the accuracy of the instrument. Of course, such individual adjustment of frets was difficult and the use of gut strings for frets impractical. More recently the use of frets which are angled or curved across the fret board, as opposed to traditional straight, perpendicularly disposed frets has been proposed. U.S. Pat. No. 6,069,306 discloses the repositioning of frets to compensate for intonation errors inherent in instruments utilizing fret boards constructed in accordance with the "Rule of Eighteen." However, the resulting fret board is radically different from a traditional fret board with radically differing fingering positions for the various notes. As a result the proposed instrument is extremely difficult to play. In view of the above, it will be recognized that the prior art fails to provide a practical fretted instrument offering precise intonation at each fret position without substantially compromising the playability of the instrument.

Other patents addressing the question of improving the accuracy of intonation in a fretted instrument include U.S. Pat. Nos. 3,787,600; 5,063,818; 5,750,910; 5,760,322; 5,814,745; 6,114,618; 6,426,454; 6,433,264; 6,583,346; and 6,706,957. Further patents disclosing the construction of fretted instruments include U.S. Pat. Nos. 4,064,780; 4,982,640; 5,631,432; and 6,825,406.

BRIEF SUMMARY OF THE INVENTION

The present invention provides a fretted stringed instrument which achieves accurate intonation at each fret position along each string. The instrument includes a body provided with a bridge for supporting a plurality of strings, and includes a neck secured to the body. The neck is provided with a nut proximate its distal end for supporting the plurality of strings, and includes an fret board extending longitudinally along a substantial portion of the neck. The fret board is provided with a plurality of frets having offset string contact regions along their length whereby accurate intonation of a note is achieved when a string is brought into contact with one of the string contact regions and a note is played. In one embodiment of the invention the fret board defines periodic transversely oriented facets which undulate along the length of the fret board. As a result the fret board defines a playing surface which rises to high points where the frets are located, and inclines to low points disposed between adjacent frets.

The present invention also provides a fret mapping method for determining the proper location for the string contact regions of the frets of an instrument of the present invention. The method utilizes a test instrument having a body provided with a bridge for supporting a plurality of strings and having a neck which includes a nut for supporting such strings. The neck of the test instrument is provided with a fret board that defines a distal edge and that is longitudinally movable toward and away from the nut of the test instrument. The fret board also includes a plurality of frets positioned at known distances from the distal edge of the fret board. In accordance with the method of the present invention, and in summary, the strings are tuned to a desired open tuning, and the fret board is positioned such that the distal edge of the fret board is a known distance from the nut. A note is played on a string at a preselected fret and it is determined whether such note is sharp or flat. If the note is sharp or flat, the intonation error is corrected by longitudinally moving the fret board with respect to the nut such that the fret at which the note was been played is moved to a position to produce the correct intonation. The corrected position of the fret is then recorded such that the recorded data can be used in the construction of a stringed instrument in accordance with the present invention. This procedure is repeated with respect to each fret position on each string, thereby allowing the desired string contact regions of an entire fret board to be mapped.

BRIEF DESCRIPTION OF THE SEVERAL VIEWS OF THE DRAWINGS

The above-mentioned features of the invention will become more clearly understood from the following detailed description of the invention read together with the drawings in which.

DETAILED DESCRIPTION OF THE INVENTION

Figure 1:
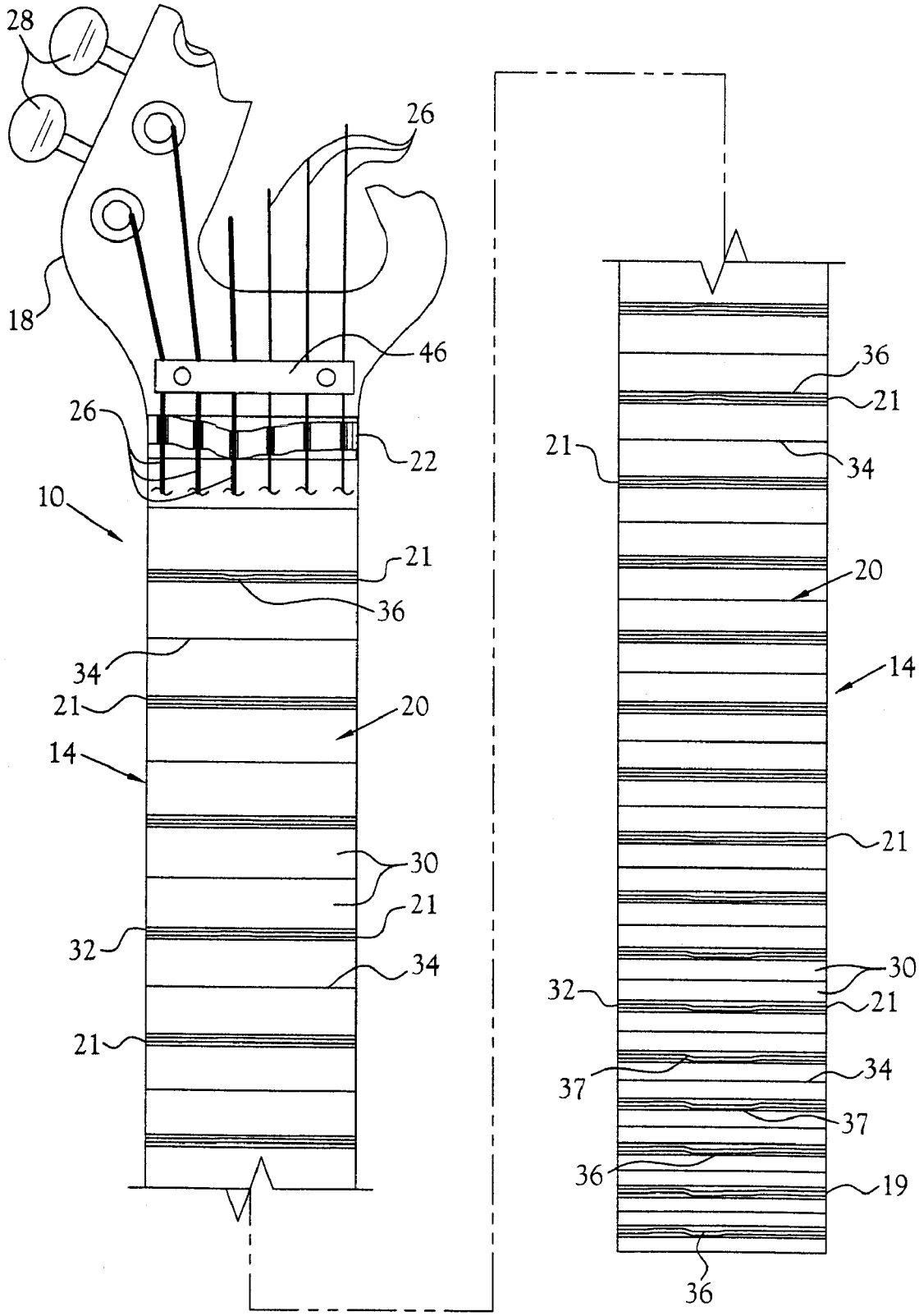
FIG. 1 is an exploded plan view of the fret board and a portion of the neck of a stringed instrument of the present invention.

A stringed instrument in accordance with the present invention is illustrated generally at 10 in the drawings. As discussed in detail below, the stringed instrument 10 incorporates a neck with a fret system which corrects the intonation inaccuracies found in conventional fretted stringed instruments utilizing straight, parallel frets which are disposed perpendicular to and along the length of the longitudinal axis of the fret board of the instrument. Whereas, a guitar incorporating various features of the present invention is disclosed in the drawings and discussed herein, it will be understood that various other stringed instruments could incorporate the present invention.

The stringed instrument 10 includes a body 12 (see FIG. 5) to which is secured a neck 14. The neck 14 defines an elongated trunk portion 16 (see FIG. 6) which carries a head member 18 at its distal end, and which is secured to the body 12 at its proximal end portion 19. The neck 14 also includes a fret board 20 which overlays and is supported by the trunk portion 16, and which extends longitudinally along a substantial portion of the neck 14. As will be discussion in more detail below, the fret board 20 is provided with a plurality of selectively spaced frets 21. Further, a nut 22 is positioned at the distal end of the fret board 20 in order to support the strings 26 of the instrument 10, and a bridge 24 (see FIG. 5) is mounted on the body 12 to support the proximal ends of the strings 26. As will be understood by those skilled in the art, the strings 26 of the instrument 10 are anchored at, or proximate the bridge 24, and the vibrating or sound generating portion of the strings extends between the bridge 24 and the nut 22 so as to overlay the fret board 20. Further, each of the strings 26 extends over the nut 22 and is anchored to a tuning machine 28 which is used to increase or decrease the tension on the string 26 to allow the string 26 to be tuned.

In one preferred embodiment the playing surface of the fret board 20 is formed with periodic transversely oriented facets 30 (see FIGS. 1 and 2) which undulate as is described in my earlier U.S. Pat. No. 5,631,432. In this regard, the playing surface defines a slight transverse arc which rises to high points defined as the arc land regions 32 where the frets 21 are positioned, and inclines to low points 34 substantially midway between the frets 21. Preferably the entire playing surface of the fret board 20 is undulated in this manner, with the opposing facets 30 between the frets 21 defining obtuse angles. The included angle may be on the order of 170-188 degrees with the result that a slightly depressed region is formed between adjacent frets 21. However, other angles could be used. Further, the transverse arc on which the facets 30 are formed may be on the order of a 12" radius, but other radii could be use, and such arc could define a compound radius.

Figure 2:
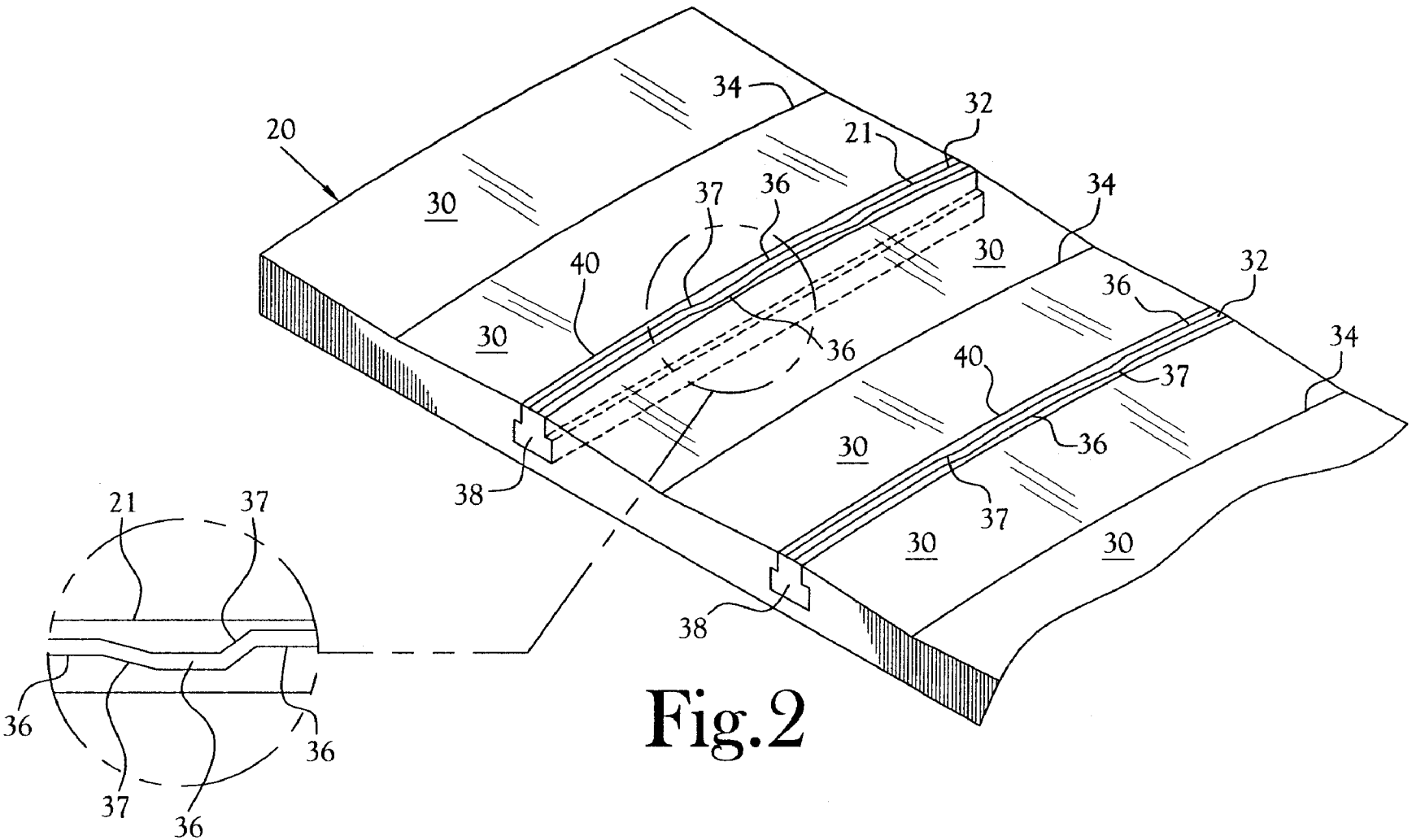
FIG. 2 is a partial perspective view of the fret board of a stringed instrument of the present invention.

As best illustrated in FIGS. 1-2, the instrument 10 includes at least a plurality of frets 21 which are configured to define raised string contact regions 36 associated with each string, such regions 36 being longitudinally positioned relative to vibrating length of the associated string 26 to correct intonation errors which would otherwise result from the use of conventional frets having linear contact surfaces that extend along the length of the frets. In this regard, the frets 21 are preferably configured such when a string 26 is depressed against a particular contact region 36 accurate intonation of the desired note results. As will be discussed below with respect to the fret mapping method of the present invention, at any given fret position the longitudinal position of the contact region 36 for each given string 26 may vary. In this regard, a contact region 36 associated with a given string 26 may be in a longitudinally displaced position on the fret board 20 relative to a contact region 36 on the same fret 21 which is associated with a different string to the extent that such displacement is necessary to insure that the intonation of notes played on such strings at that fret is accurate.

Whereas the contact regions 36 of the frets 21 can be defined by frets which are curved along their length, in the preferred embodiment of the instrument 10, the contact regions 36 define linear sections which are substantial perpendicular to the longitudinal axis of the fret board 20, with the adjacent contacts regions 36 of a fret 21 being joined by a transition section 37. (See FIG. 2). By providing contact regions 36 defining linear sections there is less likelihood that inadvertent lateral movement of the string 26 as it is depressed against the contact region 36 will result in an intonation deviation. Further, this contact point configuration better accommodates the manual application of vibrato to a note. It will also be understood that this construction facilitates the proper intonation of notes on a twelve string guitar where there are pairs of strings at each contact region.

It will be recognized that the longitudinal displacement of the contact regions 36 over the length of a fret 26 could be accomplished by contouring the body of the fret over its length and providing a contoured slot in the fret board to receiver the contoured fret. However, as best illustrated in FIG. 2, in the preferred embodiment of the instrument 10 each fret 21 defines a linear base portion 38 which is secured in a linear slot in the fret board 20, and further defines an upper portion 40 which is manufactured to define the raised contact regions 36. It will be understood by those skilled in the art that it is the point of the string's last contact with the fret as the string extends toward the bridge, or leading edge, which determines the frequency of the note generated. Accordingly, the upper portion 40 of each fret is manufactured such that each contact region 36 defines a leading edge which will produce an accurately intoned note when a string is depressed against the fret. However, by providing the frets 21 with the linear base portions 38, the installation of the frets is made easier since linear slots in the fret board 20 will accommodate the frets.

It is contemplated that the frets 21 could be made from various strong durable metals. Further, where a metal is used, various manufacturing methods could be used to configure the frets 21, but it is contemplated that one suitable method would be to utilize coining die technology to shape the contact regions 36 in the upper portions 40 of the frets 21. It is also contemplated that minerals such as natural or synthetic ruby, sapphire or other hard, durable gem stones could be used. In this regard, it will be understood that various gem stone materials are strong and durable, and frets made from such materials can enhance the appearance of the resulting instrument. Further, it is contemplated that the frets 21 could be made from various ceramic materials. It will also be noted that the frets 21 with their contact regions 36 can be integrally formed with the fret board 20. For example, the fret board 20 with the integrally formed frets 21 can be made of aluminum or other strong durable metal or graphite materials. Where aluminum is used, the fret board surface is preferably hard coat anodized to ensure that the integrated frets and playing surface are sufficiently strong and durable.

Figure 3:
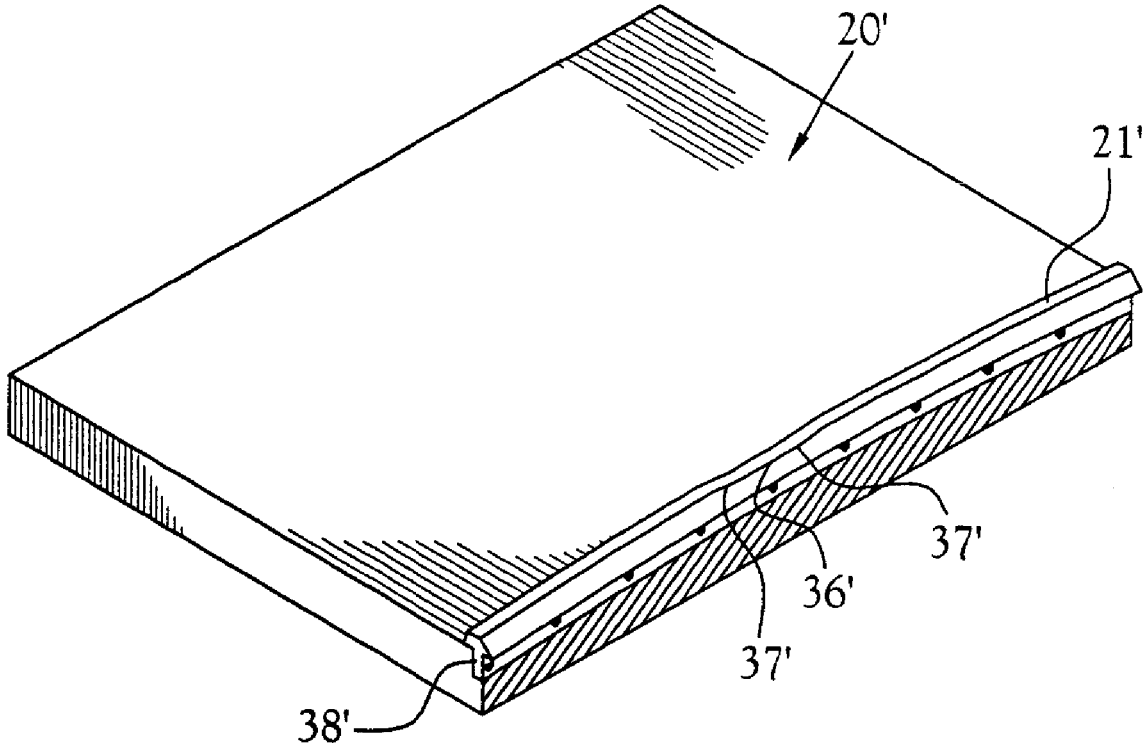
FIG. 3 is a partial perspective view of an alternate embodiment of the fret board of a stringed instrument of the present invention.

As illustrated in FIG. 3, it is contemplated that the frets of the instrument 10, with the longitudinally offset contact regions, could be used with a conventional fret board wherein the playing surface does not undulate between frets. Thus, as illustrated, the instrument 10 can include a non-undulating fret board 20' having frets as disclosed at 21' in FIG. 3 incorporating contact regions 36' and transition sections 37'. However, it has been discovered that use of the undulating fret board of my prior U.S. Pat. No. 5,631,432 in combination with the frets 21 allows the amount of the longitudinal offset of the contact regions 36 along a particular fret to be minimized while still achieving the desired intonation correction. In this regard, intonation deviations occurring in instruments utilizing straight frets spaced in accordance with the modified "Rule of Eighteen" are in large part a product of the variations in the tension placed on a strings when they are depressed at varying locations along the fret board. With a conventional fret board such variations in tension can be substantial such that contouring the frets to correct intonation deviations can result in radical displacement of the frets as is illustrated in U.S. Pat. No. 6,069,306. The resulting instrument can be very difficult to play because of the irregularity of the fret positions. The undulating playing surface described above substantially decreases the pressure necessary to depress a string at any given location, resulting in a substantial reduction in the tension on the string. Consequently, the longitudinal displacement of contact regions 36 along the length of a fret is minimized thereby avoiding the radical displacement of frets which is seen in prior art instruments which seek to correct intonation errors through the contouring or displacement of frets. It will, however, be recognized that even where the preferred undulating playing surface of the present invention is not used, the particular fret configuration of the present invention offers advantages over the prior art.

Figure 4:
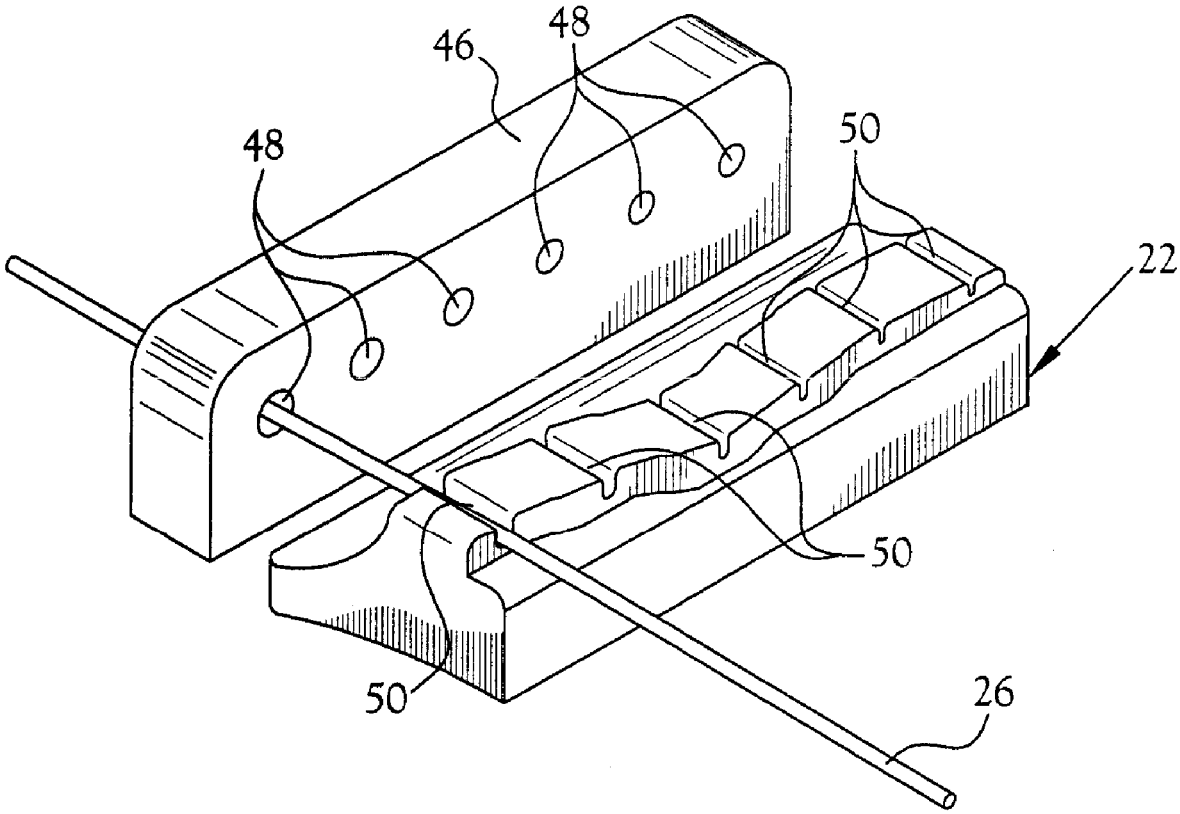
FIG. 4 is a perspective view of the nut and sting loom of a stringed instrument of the present invention.

In order to further minimize the displacement of the contact regions 36 along a given fret 21, in one preferred embodiment of the instrument 10 the nut 22 is contoured such that the vibrating length of individual open strings varies. Also, the bridge 24 is adjustable such that the vibrating length of individual strings can be adjusted. Those skilled in the art will recognized that adjustable bridges, such as the bridge 24, are commonly used to allow the vibrating length of individual strings to be adjusted such that correct intonation can be set at the octave (the twelfth fret on a typical guitar). In this regard, being able to adjust the vibrating length of a string allows the exact middle of the string to be placed over the contact point of the octave fret such that intonation is correct at the octave. The bridge 24 (see FIG. 5) is typical of bridges commonly used, and includes a saddle 42 for supporting each string 26, with each saddle being moveable between a forward and a rearward position through the adjustment of a screw 44 or other actuating mechanism. In the instrument 10 the relative vibrating lengths of the open strings is further manipulated through the use of the contoured nut 22 best illustrated in FIG. 4. In this regard, it has been discovered that, due to the different tension characteristics of the various strings, and the resulting differences in fret displacement necessary for intonation corrections, preselecting the vibrating length of each string relative to the others allows the longitudinal offset of the contact regions 36 on any given fret 21 to be minimized. Thus, for example, in the guitar nut 22 illustrated in FIG. 4 the leading edge of the nut 22 at the point where the low E string is supported is distally displaced from the leading edge of the nut 22 at the point where the A string is support, allowing the E string to have a longer vibrating length between the nut 22 and the octave than the A string. The most desirable contour for the nut 22 will depend on the gauge composition of the strings being used. Therefore, it is contemplated that an adjustable nut, such as that disclosed in U.S. Pat. No. 5,481,956, could be used instead of the contoured nut 22 if desired. It will also be noted that in the preferred embodiment of the instrument 10 a string loom 46 is provided between the nut 22 and the tuning machines 28. The string loom 46 defines holes 48 for each string 26 which are aligned with the grooves 50 in the nut 22 through which the strings 26 extend. Thus, the string loom 46 aligns the strings 26 before they engage the nut 22 thereby reducing the tension on the strings 26 proximate the nut.

Figure 6:
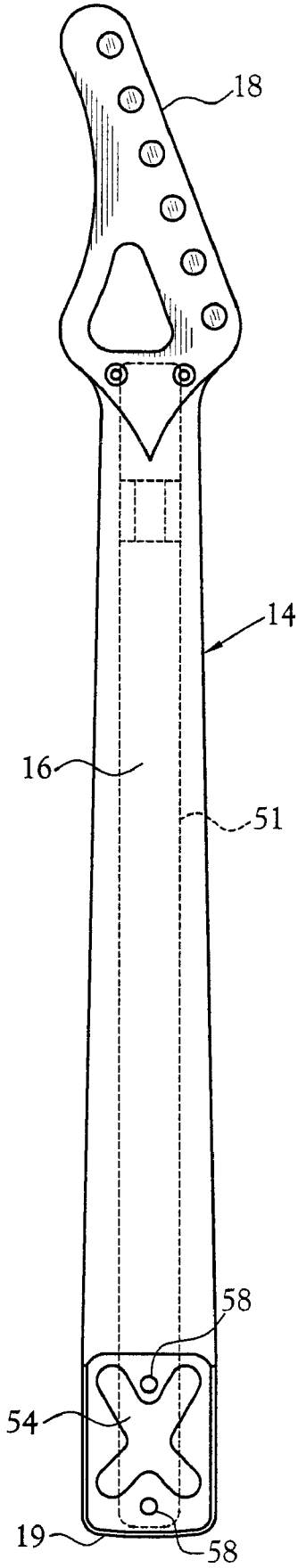
FIG. 6 is a rear view of the neck of a stringed instrument of the present invention.

It will be recognized that in order to preserve the precise intonation offered by the fret board configuration of the instrument 10 it is desirable to have a stable neck structure, and to have a junction between the neck 14 and the body 12 of the instrument which is as stable and durable as possible. Therefore, as illustrated in FIG. 6, in one preferred embodiment of the instrument 10 a support beam 51 is embedded in the trunk portion 16 of the neck 14 to stabilize the neck structure. The support beam 51 is preferably made from a strong durable metal such as aluminum. For example, in one embodiment the beam 51 is made from a ⅜" by 1" by 19" piece of aluminum which extends a substantial portion of the length of the neck 14. However, other strong, durable materials could be used, and the dimensions of the beam 51 can vary.

Figure 5:
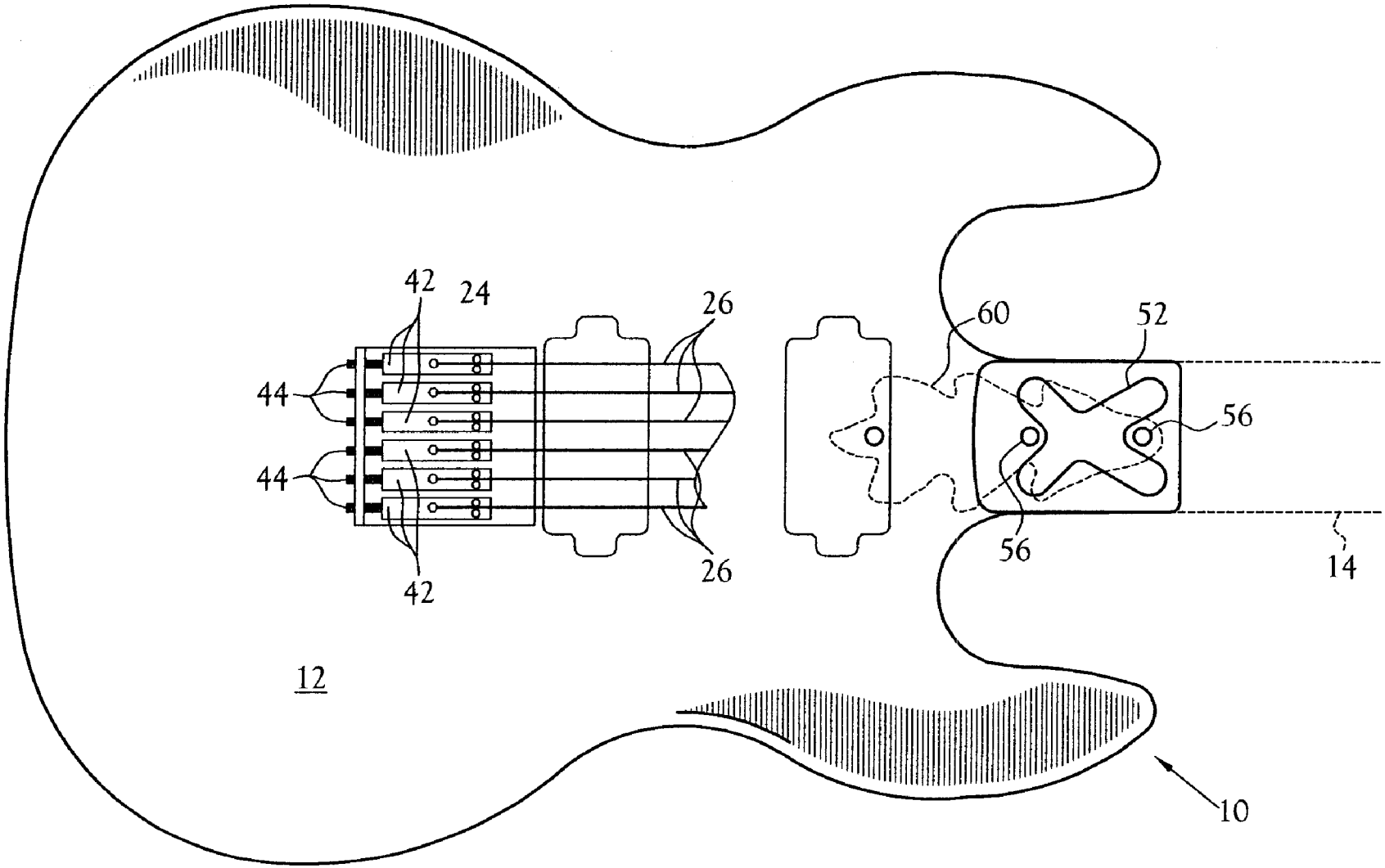
FIG. 5 is a top plan view of the body of a stringed instrument of the present invention.
Figure 7:
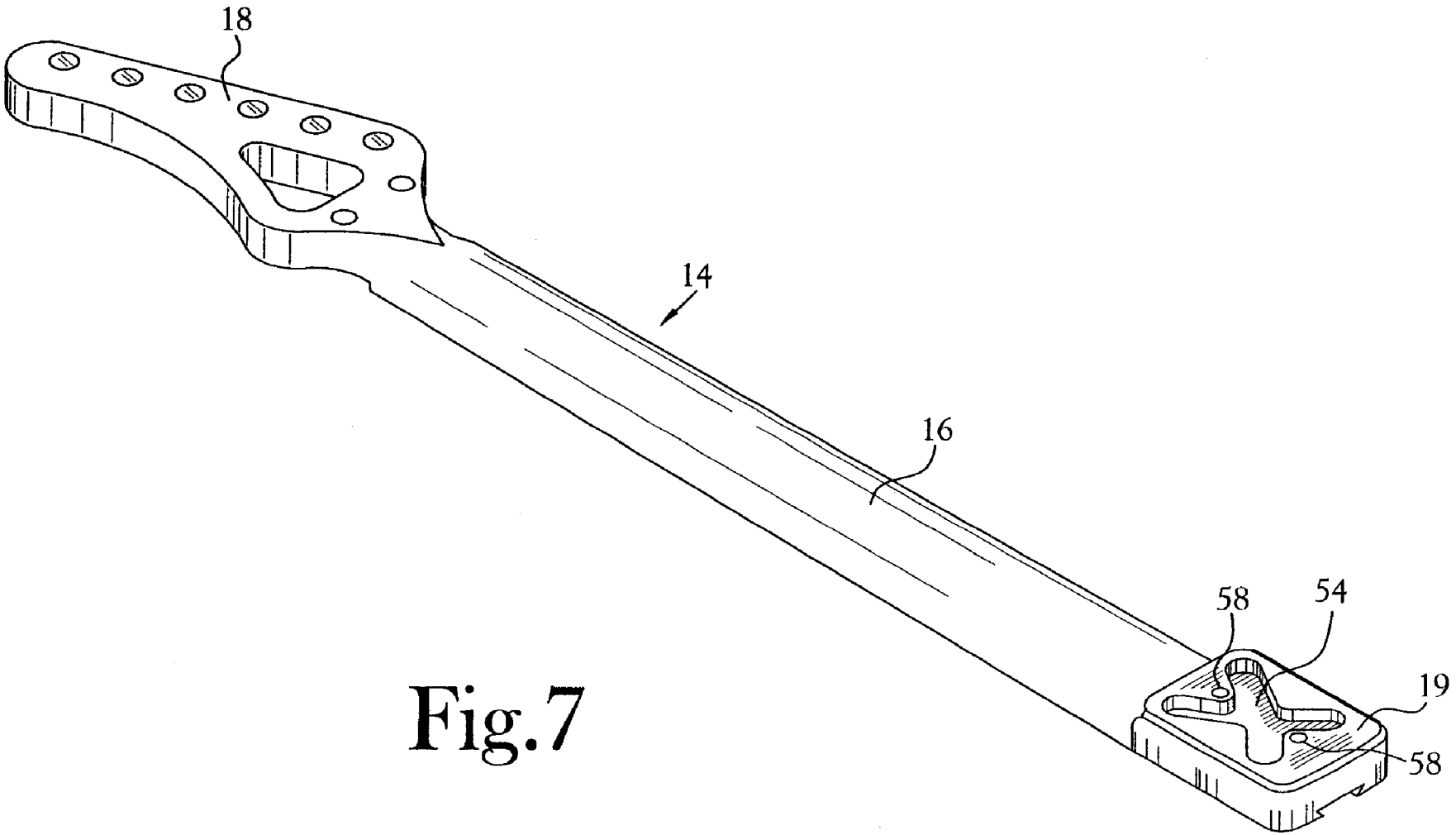
FIG. 7 is a rear perspective view of the neck of a stringed instrument of the present invention.

Further, in the preferred illustrated embodiment the junction between the body 12 and the neck 14 is reinforced with a mortise and tenon joint to stabilize the position of the neck 14 with respect to the body 12. As illustrated in FIGS. 5 and 7, the body 12 is provided with an X-shaped tenon 52. Further, the proximal end portion of the trunk portion 16 of the neck 14 defines a mortise 54 which closely receives the tenon 52. Whereas other shapes could be used, the X-shaped mortise and tenon joint is particularly advantageous for prohibiting both longitudinal and lateral movement of the neck 14 with respect to the body 12. It will also be noted that, in the illustrated embodiment, holes 56 are provided through the body 12 and registering holes 58 are provided in the neck 14 for receiving threaded fasteners (not shown) to allow the neck to be releasably secured to the body 12. Further, in one embodiment, a metal plate 60 is provided through which the threaded fasteners are insert before being inserted through the body 12 to insure that even securing force is applied to the junction between the body 12 and neck 14.

Figure 9:
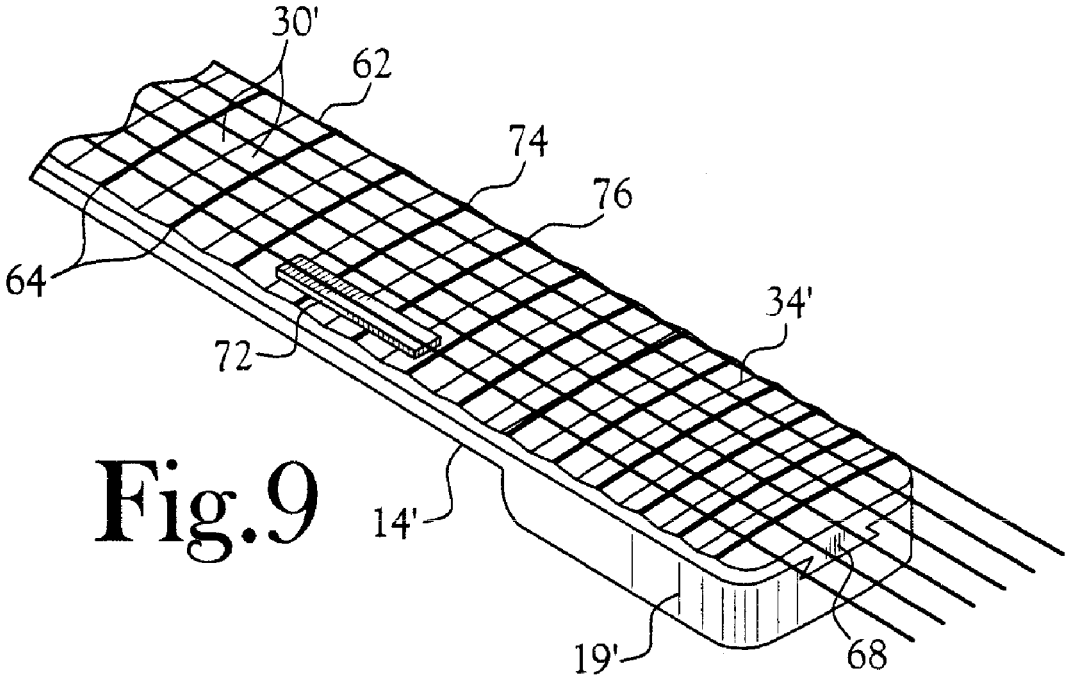
FIG. 9 is a partial perspective view of the neck of the test instrument used in connection with the fret mapping method of the present invention.

The present invention also provides a fret mapping method for mapping the contact regions 36 on a fret board in order to facilitate the construction of an instrument 10. As illustrated in FIG. 9, the method utilizes a test instrument 61 which is provided with a fret board 62 that slides longitudinally with respect to the rest of the neck 14'. The fret board 62 is provided with a plurality of frets 64 which are each in a known location. For example, the frets 64 can be linear frets that are parallel to each other and disposed perpendicular to the axis of the fret board 62 along its length in accordance with the modified "Rule of Eighteen" with the exception that the length of the fret board 62 from the first fret 64' to the distal edge 66 of the fret board 62 is shortened by a known distance so as to be that known distance less than is called for by the modified "Rule of Eighteen." As will be discussed below this shortening of the fret board 62 allows the frets 64 to be selectively moved toward the nut 67 to facilitate the mapping of desired the contact regions 36.

Figure 8:
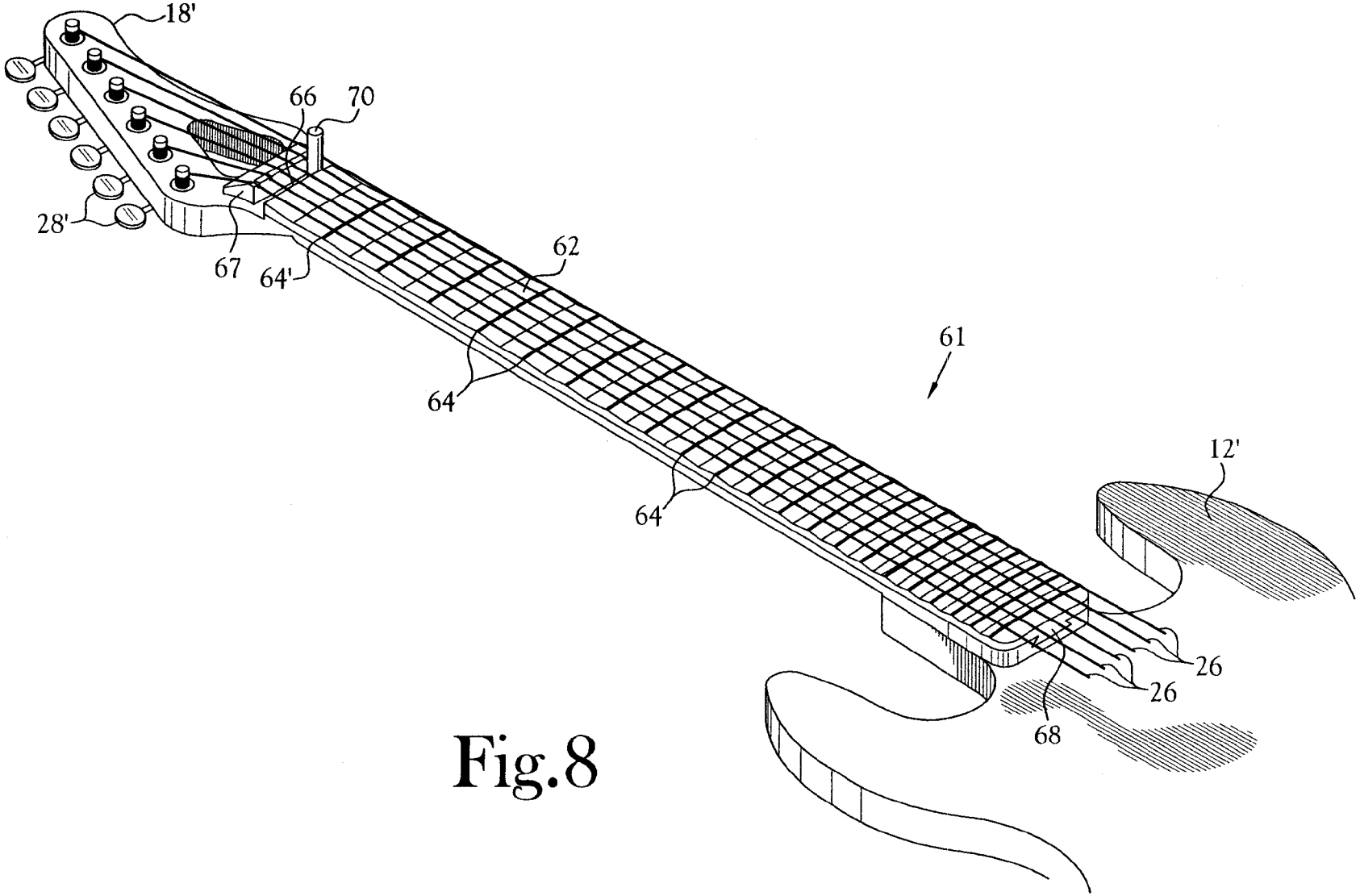
FIG. 8 is a perspective view of the neck of a test instrument used in connection with the fret mapping method of the present invention.

As illustrated in FIGS. 8 and 9, in one embodiment the longitudinal movement of the fret board 62 with respect to the neck 14' is accomplished by providing a sliding dovetail joint 68 between the fret board 62 and trunk portion 16' of the neck. However, it will be understood that various mechanisms could be used to accomplish the desired sliding longitudinal movement.

It will be recognized that by longitudinally sliding the fret board 62 with respect to the rest of the neck 14' the frets can be moved at any given fret and string position to place the fret in position for accurate intonation. For example, and as will be discussed in greater detail below, the fret board 62 can be initially positioned such that the frets are in a known position relative to the nut and bridge, such as in accordance with the modified "Rule of Eighteen". The open strings can then be accurately tuned using a frequency measuring device such as a tuner, and a note can be played at, for example, the first fret 64' on the low E string with the intent being to produce an F note. Intonation can be tested with a frequency measuring device such as a tuner (preferably a precision tuner), and if the intonation is incorrect and the desired F note is not produced, the fret can be moved either toward, or away from, the nut 67 to correct the intonation error. Once the fret has been positioned to provide accurate intonation, the position of the fret relative to the nut 67 or the bridge can be recorded, such recorded position being the desired contact point for producing an F on the low E string at the first fret 64'. The procedure can be repeated with respect to each fret position for each string resulting in the mapping of the desired positions for the contact regions 36 along each fret 64 on the fret board 62. This data can then be used to configure and position the frets on an instrument 10 of the present invention.

In one embodiment of the fret mapping method of the present invention the method incorporates a position measuring system which facilitates the locating of desired fret contact regions 36, and facilitates the determination of the position of such regions 36 relative to the nut 67 of the test instrument 61. As discussed above, the fret board 62 is shortened a known distance between the first fret 64' and the distal edge 66 of the fret board 62. For example, the distance can be 0.25 inches, such that when the distal edge 66 is spaced 0.25 inches from the leading edge of the nut 67 the first fret 64' is positioned in accordance with the modified "Rule of Eighteen". This spacing of the distal edge 66 from the nut 67 can be facilitated by inserting a precision ground gauge pin 70 having a diameter of 0.25 inches between the distal edge 66 of the fret board 62 and the leading edge of the nut 67. A plurality of gauge pins having different diameters either greater or less than 0.25 inches are also provided to allow the fret board 62 to be selectively spaced known distances from the nut 67 to correct intonation errors which are detectable when the 0.250 inch gauge pin is utilized. For example, use of a smaller diameter gauge pin 70 will move the particular fret being tested toward the nut 67 to correct a sharp condition detected while using a spacing of 0.250 inches. In this regard, reducing the gauge pin size from 0.250 inches to 0.243 inches will move the fret being tested 0.007 inches closer to the nut 67 resulting in a 1 cent frequency correction. Thus, by selectively using gauge pins 70 having different known diameters of either greater or less that 0.250 inches, corrections can be made to the fret position, and the known diameter of the particular gauge pin 70 which results in proper displacement for accurate intonation provides the data necessary to determine the corrected position of desired contact region 36.

In light of the above it will be understood that in one application of the fret mapping method of the present invention wherein the fret positions of a guitar are being mapped, the test instrument 61 is provided with a plurality of strings 26' of a known gauge composition. In this regard, because the string surface irregularities resulting from the helical windings on a wound string can cause intonation discrepancies due to irregular contact with the frets, flat wound strings are preferably used for mapping the fret contact regions 36.

Figure 10:
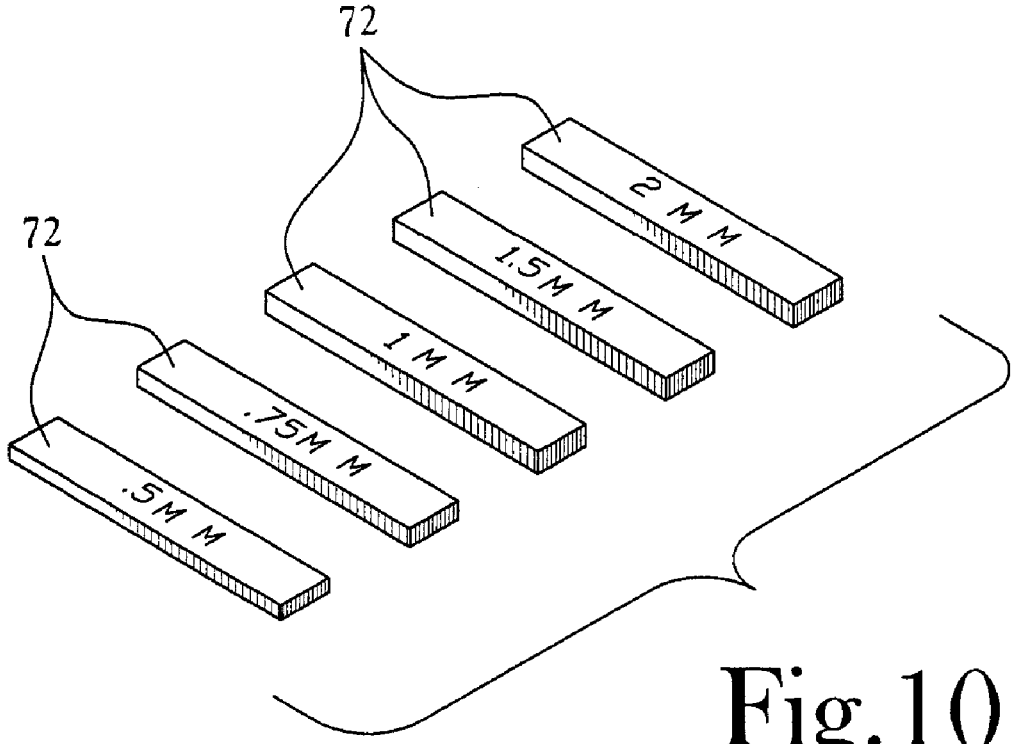
FIG. 10 is a perspective view of gauge blocks used in connection with the fret mapping method of the present invention.

The fret board 62 is then positioned with a 0.250 inch gauge pin between the leading edge of the nut 67 and the distal edge 66 of the fret board 62. The desired playing action or playing height of the strings is then set, this being the height of the strings above the frets. It will be understood by those skilled in the art that the playing height of the strings is a matter of preference and it is typically adjusted by adjusting the height of the bridge or the height of the individual bridge saddles which support the strings. To facilitate the setting of the desired playing height, in one application of the method of the current invention a gauge block 72 of known thickness is placed on the fret board 62 underneath the string being set such that the gauge block 72 spans the $12^{th}$ and $13^{th}$ frets 74 and 76, respectively. For example, if a playing height of 1.5 millimeters is desired, a gauge block 72 having a thickness of 1.5 millimeters is positioned beneath the string and the string height is adjusted such that the bottom of the string is at the level of the upper surface of the gauge block 72. Of course, as illustrated in FIG. 10, gauge blocks 72 having various thicknesses can be provided so as to accommodate the setting of different playing heights. It will also be recognized that the gauge blocks 72 can be used to set the playing height of the strings of a completed instrument 10, or the playing heights of the strings of various other fretted instruments.

Once the playing height of each string has been set, the open strings are tuned to produce the desired open notes. Where the instrument in question is a guitar the first string will typically be tuned to E, the second string to B, the third string to G, the fourth string to D, the fifth string to A and the sixth string to E. To insure the accuracy of the tuning, a frequency measuring device such as a tuner is preferably used. One suitable device is a strobe tuner such as the Peterson strobe tuner Model 490. Once the open strings have been accurately tuned, the required displacement of the frets to achieve accurate intonation is mapped. For example, the high E string is depressed to contact the first fret 64' and the note is played, the desired note being an F. The frequency of the note is measured to determine if the note is sharp or flat. If, for example, the note produced is sharp, the 0.250 inch gauge pin can be replaced with a gauge pin having a smaller diameter thereby allowing the fret board 62 to be moved toward the nut 67 a known distance and thereby flattening the note produced at the first fret. If the note produced is flat a gauge pin having a larger diameter can be used to move the fret away from the nut 67 and sharpen the note. It will be recognized that the substitution of multiple gauge pins 70 of various diameters may be necessary in order to determine the precise fret displacement to provide accurate intonation, but the gauge pins 70 provide an accurate measure of the necessary displacement thereby insuring that the position of the fret contact region 36 is accurately determined.

Figure 11:
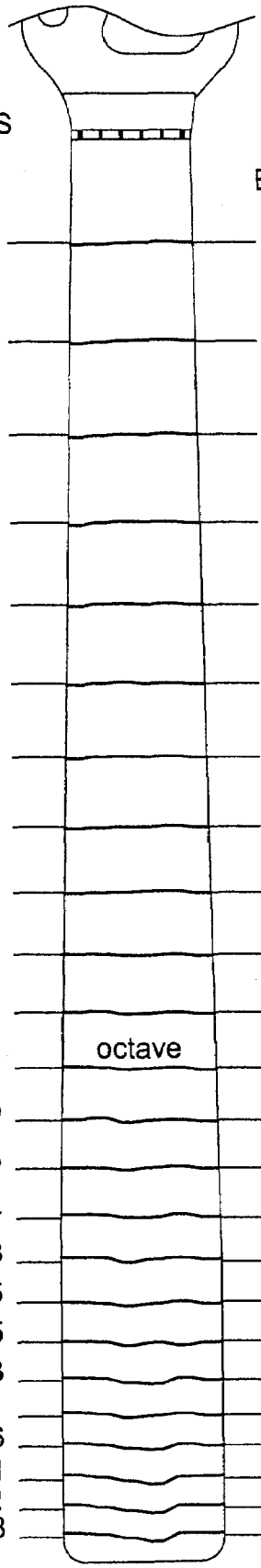
FIG. 11 is a schematic view of an example of the mapped positions of string contact regions derived in accordance with the fret mapping method of the present invention.

It will be understood that the above described process of testing the accuracy of the note at a particular fret position, and determining the required displacement of the fret contact region for proper intonation, is repeated with respect to each fret along the length of each string. As a result, the required displacement distances for positioning the fret contact regions 36 can be mapped as illustrated in FIG. 11, and such displacement distances can be utilized in the construction of an instrument 10 of the present invention.

In light of the above, it will be recognized that the present invention provides a stringed instrument 10 having great advantages over the prior art. The instrument 10 provides accurate intonation at each fret position along each string, and does so without radical repositioning to the frets. Accordingly, the instrument 10 is played like a conventional stringed instrument without the necessity of learning new finger positions to produce the desired notes or chords. Further, fret mapping method of the present invention allows the desired fret contact regions to be located with sufficient accuracy to allow the intonation of the instrument at all fret locations to be certified and traceable to the Physics Laboratory: Time and Frequency Division, at the National Institute of Standards and Technology, Washington, D.C., where a specified gauge of flat wound strings are used. Even where other types and/or gauges of strings are used the intonation deviations at all fret positions can be substantially eliminated.

While the present invention has been illustrated by description of several embodiments and while the illustrative embodiments have been described in considerable detail, it is not the intention of the applicant to restrict or in any way limit the scope of the appended claims to such detail. Additional advantages and modifications will readily appear to those skilled in the art. The invention in its broader aspects is therefore not limited to the specific details, representative apparatus and methods, and illustrative examples shown and described. Accordingly, departures may be made from such details without departing from the spirit or scope of applicant's general inventive concept.

Having thus described the aforementioned invention, We claim:

1. A fret mapping method for determining the position of string contact regions along the length of a fret of a stringed instrument, said method utilizing a test instrument having a body provided with a bridge for supporting a plurality of strings and a neck which includes a nut for supporting the plurality of strings, the neck of the test instrument being provided with a fret board that is longitudinally movable toward and away from the nut of the test instrument, the fret board defining a distal edge and including at least one fret positioned at a known distance from the distal edge of the fret board, said method including the steps of:

tuning the plurality of strings to a desired open tuning;

positioning the fret board such that the distal edge of the fret board is a known distance from the nut;

playing a note on a string at a fret on the fret board and determining whether the note is sharp or flat; and correcting any intonation deviation by moving the fret board with respect to the nut of the test instrument such that the fret at which the note has been played is moved to a position to produce correct intonation.

2. The method of claim 1 wherein said step of positioning the fret board such that the distal edge of the fret board is a known distance from the nut includes placing a gauge pin having a first known diameter between the distal edge of the fret board and the nut to set the known distance of the distal edge of the fret board from the nut.

3. The method of claim 2 wherein said step of correcting any intonation deviation by moving the fret board with respect to the nut includes inserting at least a second gauge pin having a second known diameter between the distal edge of the fret board and the nut to determine the displacement of the fret necessary to correct intonation.

4. The method of claim 3, and before the step of playing a note on a string at a fret on the fret board and determining whether the note is sharp or flat, wherein said method includes the further step of setting the strings to a preselected height above the fret board.

5. The method of claim 4 wherein said step of setting the strings to a preselected height above the fret board includes placing a gauge block having a known thickness on the fret board beneath a string so as to span two adjacent frets, and positioning the string such that the bottom of the string is at the level of the upper surface of the gauge block.

6. The method of claim 5 wherein the test instrument used includes a fret board that defines periodic transversely oriented facets which undulate along the length of the fret board such that the fret board defines a playing surface which rises to high points where the frets are located, and inclines to low points disposed between the frets.

* * * * *